United States Patent [19]

Kopysky et al.

[11] 4,370,879

[45] Feb. 1, 1983

[54] METHOD FOR MANUFACTURING A PIERCING MANDREL

[76] Inventors: Boris D. Kopysky, Schelkovskoe shosse, 85, korpus 2, kv. 43; Viktor D. Dmitriev, Yasenevo, 1 Mikroraion, korpus 7"b", kv. 104, both of Moscow; Georgy I. Khaustov, ulitsa Pestelya, 21, kv. 4, Nikopol Dnepropetrovskoi oblasti; Viktor M. Brodsky, Grechesky pereulok, 14, kv. 3, Dnepropetrovsk; Vitaly A. Surzhikov, prospekt Lenina, 41, kv. 19, Nikopol Dnepropetrovskoi oblasti; Evgeny I. Semenov, ulitsa Ivana Babushkina, 3, kv. 426, Moscow; Vladimir G. Chus, prospekt Pushkina, 25/27, kv. 32, Dnepropetrovsk; Viktor A. Misjulya, prospekt Vorontsova, 75, kv. 14, Dnepropetrovsk; Leonid F. Kandyba, ulitsa Vakhrusheva, 54, Dnepropetrovsk; Igor P. Ivanov, ulitsa Ingerina, 22, kv. 5, Dnepropetrovsk; Grigory I. Bezzub, ulitsa Adreichenko, 40, Dnepropetrovsk; Yasha F. Goldenberg, ulitsa Vakhrusheva, 1, kv. 4, Dnepropetrovsk; Ilya S. Zonnenberg, Sumskoi proezd, 12, korpus 5, kv. 30, Moscow; Alexandr G. Paly, ulitsa Pestelya, 4, kv. 1, Nikopol Dnepropetrovskoi oblasti; Arkady S. Malkin, ulitsa Pestelya, 6, kv. 1, Nikopol Dnepropetrovskoi oblasti, all of U.S.S.R.

[21] Appl. No.: 181,613

[22] Filed: Aug. 26, 1980

[51] Int. Cl.[3] ..... B21K 5/02

[52] U.S. Cl. ..... 72/377; 72/356

[58] Field of Search ..... 72/97, 209, 356, 377

[56] References Cited

U.S. PATENT DOCUMENTS

| | | | |
|---|---|---|---|
| 2,167,424 | 7/1939 | Novack | 72/209 |
| 3,036,367 | 5/1962 | Ricks | 72/377 |
| 3,314,278 | 4/1967 | Bergman | 72/377 |
| 3,962,897 | 6/1976 | Way et al. . | |

FOREIGN PATENT DOCUMENTS

| | | | |
|---|---|---|---|
| 55-73407 | 6/1980 | Japan | 72/209 |
| 599904 | 3/1978 | U.S.S.R. | 72/356 |

OTHER PUBLICATIONS

Translation of Article "Commercial Tests of Die--Forged Piercing Mandrels", B. D. Kopysky et al., Vsesoyuzny zaochny mashinostroitelny institut and Dnepropetrovsky truboprokatny zavoid im. Lenina, pp. 55, 56.

*Primary Examiner*—Lowell A. Larson

*Attorney, Agent, or Firm*—Fleit & Jacobson

[57] ABSTRACT

The invention is well adapted to the manufacture of water-cooled mandrels for use in a piercing mill. The method of the invention consists in that a cone-shaped cavity is formed in a blank by hot piercing, whereupon the blank thus formed is subjected to hot upset forging whereby it is reduced until its outer diameter at the end of the fitting section is in the range of from 0.9 to 1.02 times the diameter of the mandrel sizing band, the outer diameter of the mandrel working section and that of its nose being 0.9 to 1 times the diameters of the respective sections of the mandrel, the wall thickness in the area of the fitting section and that of the sizing band being from 0.7 to 1 times the thickness of the mandrel wall. Then, the fitting section is subjected to reduction effected concurrently with upset forging of the working section, this followed by final sizing of the mandrel setting cavity. According to one embodiment of the invention, mandrels are formed simultaneously with preshaping of the tapered cavity thereof. Hot upset forging of the blank and presizing of its cavity would result in the increase of its wall thickness, ranging from 1.25 to 2.5 times its original wall thickness. The fitting section of the mandrel is formed with the resultant deformation of its cross section ranging from 1 to 1.5 times.

4 Claims, 5 Drawing Figures

METHOD FOR MANUFACTURING A PIERCING MANDREL

BACKGROUND OF THE INVENTION

1. Field of the Invention

The present invention relates to metal working, and more particularly, to a method of manufacturing mandrels for use in a piercing mill.

The invention is well adapted for application in the manufacture of water-cooled (non-detachable) mandrels incorporated in piercing mills.

In addition, the invention can also be advantageously used in the fabrication of non-cooled (detachable) mandrels employed for similar purposes.

An ever growing demand in seamless tubes, as well as high level of automation and enhanced production efficiency of installations for hot rolling of tubes, necessitate the provision of high-quality, reliable and durable tube-rolling tools.

One of the most rapidly-wearing tools is a piercing mandrel used for forming an opening in an incandescent solid blank and made to operate under conditions of high and variable pressures and temperatures, and intensive contact stresses. It should be observed that too many factors, such as production efficiency of pilger mills, quality of the inner surface of tubes being produced, and, finally, effectiveness of the pipe and tube industry, depend on the ability of mandrels to withstand the aforementioned loads. However, severe operating conditions adversely affect service life of piercing mandrels and, consequently, lead to excessively high demand in them.

To secure good surface finish in a tube, it is necessary to frequently replace the mandrel, which lowers production efficiency of rolling and raises demand for a greater number of working tools.

Constructionally, the mandrel is a spindle-shaped body streamlined in profile. The leading end of the mandrel, or its working section, is formed with a tapered nose, whereas the trailing end thereof is formed with a conical cavity adapted to serve as a fitting section of the mandrel. Provided between the working and fitting sections of the mandrel is a sizing band. In the event of rolling tubes from carbon and medium alloy steels, it is preferred to use water-cooled (non-detachable) mandrels formed with a deep, cooled cavity and a conical cavity to enable tight fitting of the mandrel on a rod. In the rolling of tubes from high-alloy difficult-to-work steels and alloys, use is made of non-cooled (detachable) mandrels formed with shallow cavity for mounting.

Water-cooled mandrels are manufactured from medium alloy steels containing from 0.1 to 0.2% C, 1% Cr, from 3 to 4% Ni, and 1% V; whereas non-cooled mandrels are fabricated from the same grades of steel, as well as from high-alloy steels and alloys with tungsten, molybdenum, cobalt, etc.

With regard to shape, the mandrel of any type is difficult to manufacture, requiring, to a lesser or greater extent, a great deal of mechanical working on separate sections of its surface. However, taking into account the fact that the mandrel is used to form a hollow in a blank in the initial stage of rolling, the required roughness of its surface, on the order of $R_a=300-100\mu$, is ensured through casting and forging.

There are known the following methods of manufacturing mandrels (see an article by B. D. Kopysky, E. I. Semenov, L. F. Kandyba et al. in Steel magazine No. 1, pp. 55-56, 1979):

(a) subjecting a shaped casting, with or without a cavity, and effecting complete or partial mechanical treatment of this cavity;

(b) subjecting a solid or tubular blank, with or without a cavity, to forging and then effecting complete or partial mechanical treatment of the outer surface and cavity thereof.

The finished mandrel is subjected to oxidizing annealing and, if need be, the mandrel nose is spray-coated or surfaced with a high-temperature material.

Fabrication of mandrels by casting is rather efficient and effective procedure. However, due to physical specific features of the metal solidification process, the structure of metal in these mandrels is of substantially radial orientation running in perpendicular with the outer surface of the mandrel and with the sliding direction of the metal of a tubular blank, which results in an insufficient frictional engagement between the working surface of the mandrel and the blank, as well as in a low resistance to tensile tangential stress acting on the conical mounting section. Unavoidable pores and cavities, formed beneath the crust of metal, weaken the interior sections thereof and, on appearing on the surface of the mandrel in the course of its operation, they develop into defects on the interior surface of the tube. Therefore, unstable quality of the mandrels produced by casting predetermines both unstable conditions of rolling and poor quality of finished tubes. The known methods, while improving the quality of cast mandrels, namely, through additional alloying and employment of metal molds, yet substantially raise the production cost of mandrels without significantly enhancing their performance (cf. U.K. Pat. No. 1,441,052 and No. 2,176,174, and U.S. Pat. No. 3,962,897).

Today a growing number of uses are being found for forged mandrels having a compact strained structure oriented substantially along the axis of the mandrel. Such structure ensures improved mechanical properties and performance characteristics of these types of mandrels.

Irrespective of higher consumption of metal and labour, and despite the two-fold increase in the production cost, as compared with the casting method, the durability and reliability of the forged mandrels are 2 to 3 times higher, this being the decisive factor for their preferential use.

However, the forged and machined mandrels are disadvantageous from the point of view of their metallographic texture, the fibers of which are cut off during machining and thus come out onto the surface at an acute angle. Such orientation texture adversely affects wearability of the mandrel material and, consequently, shortens the service life and impairs operating stability of mandrels.

From the above it follows that prior-art methods are ineffective in that they fail to ensure the manufacture of mandrels with a requisite metal texture governing proper performance characteristics thereof.

SUMMARY OF THE INVENTION

It is an object of the present invention to provide a mandrel with the most favourable metallographic texture having its fibers conformally inscribed into the contour of the working surface of the mandrel so as to improve operating reliability and prolong its service life.

Another object of the invention is to provide such a method for manufacturing mandrels which would minimize the consumption of labour, alloying elements and power involved in the production of mandrels.

Still another object of the invention is to enhance production efficiency of the tube-rolling industry by way of bringing to a minimum idling periods, increasing the rolled tubes in length, and improving quality of the inner surface of the finished tube.

These and other objects and features of the invention are accomplished by the provision of a method for manufacturing piercing mandrels being spindle-shaped in form and having an axial, dead-end conical cavity formed on the side of the mandrel fitting section, a nose formed at the end of the mandrel working section, and a sizing band arranged between the working and fitting sections, comprising preforming a blank with a conical cavity, subjecting it to hot upset forging preceded by sizing of its cavity and followed by shaping the outer and inner surfaces of the mandrel, wherein, according to the invention, after forming the blank with a conical cavity, it is subjected to hot upset forging preceded by sizing of the blank cavity so that the outer diameter, at the end face of the fitting section is reduced to be from 0.9 to 1.02 times the diameter of the mandrel sizing band, the outer diameters of the mandrel working section and nose being from 0.9 to 1 times the diameters of the respective sections of the mandrel, and in wall thickness at the fitting and working sections from 0.7 to 1 times the wall thickness of the mandrel, this being followed by subjecting the fitting section of the mandrel to deformation effected simultaneously with upset forging of the working section thereof, and final sizing of the setting cavity.

The prescribed dimensional ratio resultant from the hot upset forging and presizing of the blank cavity ensures necessary working of its texture so as to permit the texture fibers to be conformally inscribed into the contour of the working surface of the mandrel and to secure successful forming of the mandrel fitting section during subsequent operating stage, it being the swaging and upset forging operation, followed by final sizing of the cavity. Any departure from the aforeindicated parameters would either result in the irregularity of shape of the setting cavity, which in turn would require additional machining of this surface, or in a failure to form the fitting section of a preset length, this being an irreparable flaw.

Furthermore, a failure to stick to the above parameters would lead to the formation of folds and fins over the parting plane of the tool, these also being irreparable defects.

In accordance with one embodiment of the invention, prior to hot upset forging and presizing of the cavity, the mandrel nose undergoes shaping along with formation of the conical cavity.

Combining the nose shaping procedure with the cavity formation would ensure the quality of its forming, requisite shape and dimensions, also permitting the forging force to be lowered and, consequently, the durability of the main parts of a forging press, these being a die and a punch, to be substantially improved.

It is advantageous that the hot upset forging of a blank, effected simultaneously with presizing of the cavity, would permit the blank to be increased in wall thickness by 1.25 to 2.5 times, and the fitting section of the mandrel to be altered in cross section, effected simultaneously with the swaging operation and final sizing, by 1 to 1.5 times.

It is preferred to reduce the blank in wall thickness in the event of using a shaped casting preformed with cavity. In this case, the initial cast structure is compacted in requisite zones and to a sufficient degree to ensure satisfactory performance of the mandrel.

By reducing the blank in cross section vertically of the fitting section thereof, effected simultaneously with swaging and final sizing of the latter, it becomes possible to obtain appreciably high linear and angular dimensional accuracy of this section.

BRIEF DESCRIPTION OF THE DRAWINGS

The invention will now be described, by way of example, with reference to the accompanying drawings, wherein.

Figure 1:
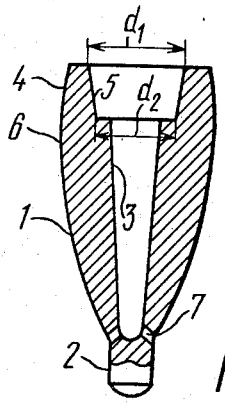
FIG. 1 is a longitudinal sectional view of a water-cooled mandrel for use in a piercing mill.

Shown in FIGS. 1,2,3,4,5 is a mandrel with elements and sections thereof being formed in the following sequence. First to be formed is a working section 1, then a nose 2, a cavity 3 for cooling the mandrel, a fitting section 4, a conical setting cavity 5, a sizing band 6, and water outlet openings 7. $d_1$ and $d_2$ are the diameters of the conical setting cavity of the mandrel; $d_5$ is the diameter of the large base of the presized conical cavity. $D_1$ and $D_2$ are respectively the diameters of the mandrel sizing band and fitting section; $D_3$ is the diameter of the end face of the blank at the stage of presizing the conical cavity; $D_4$ and $D_5$ are the diameters of the mandrel in the area of the working section thereof; $d_4$ and $d_5$ are the diameters of the mandrel nose; $S_o$ and $S_1$ are respectively thicknesses of the wall at the working section 1 and the fitting section 4 of the blank; $S_o'$ and $S_1'$ are thicknesses of the wall at the respective sections of the mandrel.

Figure 3:
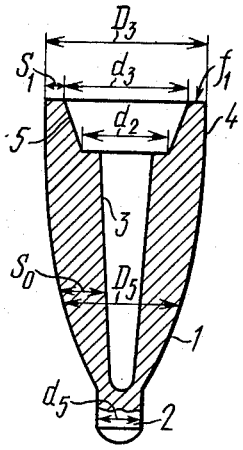
FIG. 3 is a longitudinal sectional view of a blank with a presized conical cavity.
Figure 4:
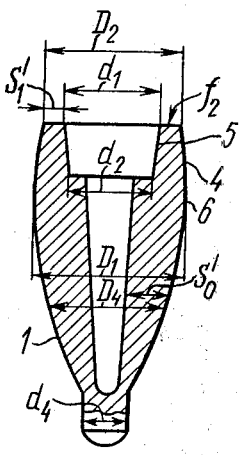
FIG. 4 is a longitudinal view of a mandrel at the final stage of its forming.

The areas of the end faces of the finished items are shown in FIGS. 3 and 4 at $f_1$ and $f_2$, respectively.

An initial blank in the form of a rolled bar piece is heated in a furnace to a forging temperature, whereupon it is subjected to upset forging effected in several passes in a closed-die press in a manner to permit abutted relation with the preformed cavity 3, and simultaneously forming the nose 2 (FIG. 2) at the tapered end of the working section 1.

In the course of further forging, the conical cavity 3 formed in the blank is presized, and the conical setting cavity 5 is shaped in conformity with the predetermined diameters $d_2$ and $d_3$. At this stage the blank is worked to the following dimensions: $D_3=/0.9$ to $1.02/D_1$; $D_5=/0.9$ to $1/D_4$; $d_5=/0.9$ to $1/d_4$; $S_1=/0.7$ to $1/S_1'$; $S_o=/0.7$ to $1/S_o'$ (FIG. 3).

Final shape is given to the mandrel in a sizing die, wherein the fitting section 4 is reduced to the diameter $D_2$, the setting cavity 5 is sized to diameters $d_1$ and $d_2$, while the working section 1 is reduced to diameter $D_4$, with the fitting section being reduced in cross section accounting for $f_1/f_2=1$–$1.5$ (FIG. 4).

Figure 5:
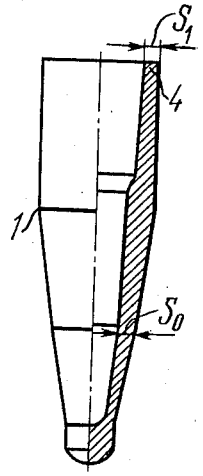
FIG. 5 shows the blank in the form of a shaped casting preformed with conical cavity.

To reduce the number of forging operations, a blank with preformed cavity should be obtained by mold casting (FIG. 5). However, in order to increase the amount of working of the cast structure by means of further hot forging, it is necessary to perform a greater amount of deformation in various regions of the blank wall, accounting for 1.25 to 2.5 times the original thickness thereof. The water outlet openings 7 are formed by drilling.

The dimensional ratios and operating conditions predetermined by the method of the invention make it possible to manufacture the mandrels of the type suitable for commercial use requiring a minimum or no finish working at all. A failure to adhere to these dimensional ratios and operating conditions would result in irreparable flaws to render the mandrels unsuitable for operation.

The invention will now be described with reference to the following illustrative example.

A blank 65 mm in dia and 147 mm in length, formed of steel containing 0.12% C, 1% Cr, 3% Ni, was used to be forged into a mandrel having 77 mm in dia, 205 mm in length, and 3.8 kg in weight.

Figure 2:
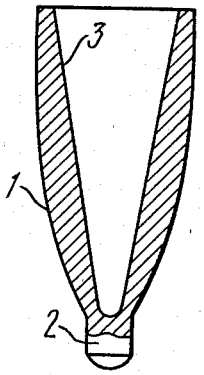
FIG. 2 is a longitudinal sectional view of a blank with a preformed conical cavity.

The blank was heated to a temperature of 1250° C., then placed into a die wherein a conical cavity and a nose 25 mm in dia were formed by piercing and stamping /FIG. 2/. Afterward, the mandrel cavity was sized to be 175 mm in depth /FIG. 3/, whereupon the mandrel working section was subjected to deformation performed simultaneously with the sizing of the setting cavity, with the amount of cross-sectional reduction in this area being in the range from 1 to 1.5 times its original cross section /FIG. 4/. On completion of forging, the mandrels were formed with 3-mm holes drilled in the area of the nose 2 (FIG. 1).

Good wearability of the mandrels manufactured in accordance with the method of the invention has been proved during control tests conducted at a continuous tube rolling mill. The mandrels used as part of a piercing mill have been found capable of withstanding, on the average, about 1920 passes, which is 4.5 times higher than the wearability of cast mandrels operating under similar conditions (430 passes), and 1.5 times higher than the wearability of the forged and turned mandrels made of steel containing 0.20% C, 1% Cr, 4% Ni, 1% V (1300 passes).

When subjected to metallographic analysis, the mandrel metal revealed extremely compact fibrous texture oriented conformally to the outer surface of the mandrel.

It has been also found that the mandrels made of steel of the above composition and manufactured in accordance with the method of the invention do not require additional heat treatment, as it fails to improve their performance characteristics. This is not saying that annealing may not be effective for other materials.

The use of a shaped casting as the initial blank for forging the mandrel 77 mm in dia and 205 mm in length had shown that the mandrel wearability was increased twice as much (from 430 passes it went up to 900 passes). The metal was well compacted in the zones exposed to especially severe stresses.

What is claimed is:

1. A method of manufacturing a piercing mandrel being spindle-shaped in form and having an axial, dead-end conical cavity formed on the side of the mandrel fitting section, a nose formed at the end of the mandrel working section, and a sizing band arranged between the working and fitting sections, comprising:

preforming a blank with an enlarged conical cavity having dimensions greater than those of the dead-end conical cavity by way of hot piercing;

presizing said blank so that the dimensions of the enlarged conical cavity are reduced and the outer diameter of the blank, at the end face of the fitting section, is reduced to be from 0.9 to 1.02 times the diameter of the mandrel sizing band, the outer diameters of the mandrel working section and nose being from 0.9 to 1 times the diameters of the respective sections of the mandrel, and the wall thickness at the fitting and working sections being from 0.7 to 1 times the wall thickness of the mandrel; and subjecting the presized blank to hot upset forging thereby forming the fitting section of the mandrel by deformation, simultaneously with upset forging of the working section of the mandrel, and performing final sizing of the said dead-end conical cavity of the mandrel.

2. A method as claimed in claim 1, wherein prior to hot upset forging and presizing of the blank, the mandrel nose undergoes shaping along with formation of the conical cavity.

3. A method as claimed in claim 1, wherein the presizing of the blank increases the wall thickness by 1.25 to 2.5 times its original wall thickness.

4. A method as claimed in claim 1, wherein the fitting section of the mandrel is formed with the resultant deformation in the mandrel cross-section, accounting for 1 to 1.5 times its original cross section.

* * * * *